US007299746B2

(12) United States Patent
LaPorte

(10) Patent No.: US 7,299,746 B2
(45) Date of Patent: Nov. 27, 2007

(54) REFUSE BIN INCLUDING A COMPACTING MECHANISM

(75) Inventor: Yvan LaPorte, Quebec (CA)

(73) Assignee: Garbage Genie Concept 2000 Limited, Dublin (IE)

( * ) Notice: Subject to any disclaimer, the term of this patent is extended or adjusted under 35 U.S.C. 154(b) by 0 days.

(21) Appl. No.: 10/556,991

(22) PCT Filed: May 13, 2004

(86) PCT No.: PCT/IE2004/000070

§ 371 (c)(1),
(2), (4) Date: Oct. 13, 2006

(87) PCT Pub. No.: WO2004/101399

PCT Pub. Date: Nov. 25, 2004

(65) Prior Publication Data

US 2007/0084358 A1 Apr. 19, 2007

(30) Foreign Application Priority Data

May 15, 2003 (IE) ..... S2003/0370

(51) Int. Cl.
*B30B 1/04* (2006.01)
*B30B 15/06* (2006.01)

(52) U.S. Cl. ..... 100/226; 100/219; 100/229 A; 100/246; 100/295; 53/527; 220/908

(58) Field of Classification Search ..... 100/100, 100/226, 227, 228, 229 A, 229 R, 233, 240, 100/245, 246, 247, 255, 265, 283, 293, 295, 100/219; 53/527; 220/908
See application file for complete search history.

(56) References Cited

U.S. PATENT DOCUMENTS 2,533,282 A * 12/1950 Osman ..... 222/387
4,658,720 A * 4/1987 Massonnet ..... 100/226
5,090,309 A * 2/1992 Lai ..... 100/226
5,730,047 A * 3/1998 Lindsey ..... 100/90
6,314,874 B1 * 11/2001 Martorella ..... 100/226
6,851,357 B1 * 2/2005 Martorella et al. ..... 100/226
6,889,604 B2 * 5/2005 Ernst ..... 100/226

FOREIGN PATENT DOCUMENTS

DE 29919933 U1 * 1/2000

* cited by examiner

*Primary Examiner*—Jimmy Nguyen
(74) *Attorney, Agent, or Firm*—Cowan, Liebowitz & Latman, P.C.

(57) ABSTRACT

A refuse bin comprises a refuse container (10) having a top opening (12) and a lid (14) hinged relative to the container to cover the opening. A compacting mechanism is fitted to the lid and comprises a compacting plate (22) mounted under the lid and an actuating rod (24) coupled to the compacting plate through an aperture (26) in the lid. The coupling is such that the rod (24) may be maneuvered from a storage position wherein the rod lies across the top surface of the lid and the plate is drawn up under the lid to an operative position wherein the rod stands upright over the aperture in the lid and may be pushed downwardly through the aperture to push the plate down into the container. The compacting mechanism further comprises a ratchet mechanism (50, 52, 54) for releasably locking the actuating rod (24) against movement upwardly through the aperture in the lid such that refuse in the container can be compacted by force applied to an edge (48) of the lid opposite the hinge.

13 Claims, 13 Drawing Sheets

REFUSE BIN INCLUDING A COMPACTING MECHANISM

BACKGROUND AND BRIEF SUMMARY OF THE INVENTION

This invention relates to a refuse bin including a compacting mechanism.

According to the present invention there is provided a refuse bin comprising a refuse container having a top opening, a lid hinged relative to the container to cover the opening, and a compacting mechanism fitted to the lid, the compacting mechanism comprising a compacting plate mounted under the lid and an actuating rod coupled to the compacting plate through an aperture in the lid such that the rod may be maneuvered from a storage position wherein the rod lies across the top surface of the lid and the plate is drawn up under the lid to an operative position wherein the rod stands upright over the aperture in the lid and may be pushed downwardly through the aperture to push the plate down into the container, the compacting mechanism further comprising means for releasably locking the actuating rod against movement upwardly through the aperture in the lid such that refuse in the container can be compacted by force applied to an edge of the lid opposite the hinge.

The invention further provides a hinged lid for a refuse container having a top opening, the lid including a compacting mechanism comprising a compacting plate mounted under the lid and an actuating rod coupled to the compacting plate through an aperture in the lid such that the rod may be maneuvered from a storage position wherein the rod lies across the top surface of the lid and the plate is drawn up under the lid to an operative position wherein the rod stands upright over the aperture in the lid and may be pushed downwardly through the aperture to push the plate down into a container below, the compacting mechanism further comprising means for releasably locking the actuating rod against movement upwardly through the aperture in the lid such that refuse in the container can be compacted by force applied to an edge of the lid opposite the hinge.

BRIEF DESCRIPTION OF THE DRAWINGS

An embodiment of the inventions will now be described, by way of example, with reference to the accompanying drawings, in which.

DETAILED DESCRIPTION

Figure 1:
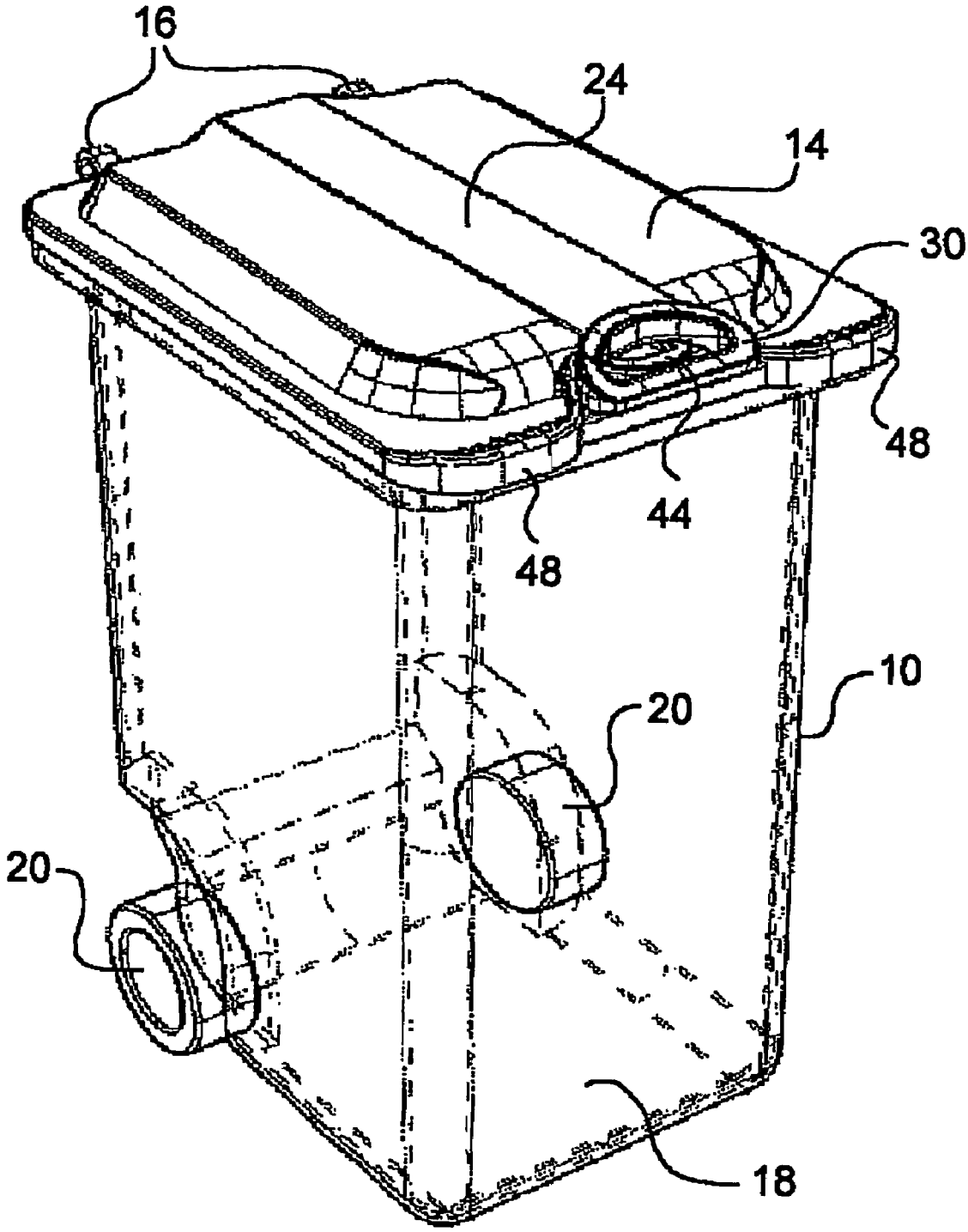
FIG. 1 is a perspective view of an embodiment of refuse bin according to the invention with the compacting mechanism.

Referring to the drawings, a refuse bin comprises a refuse container 10 of generally rectangular horizontal cross-section with a top opening 12 (FIGS. 9 and 10) and a lid 14 to cover the opening 12. The lid 14 is hinged to the container at the rear edge of the opening 12 by hinges 16 ("front" and "rear" and like expressions refer to the orientation of the bin as seen in FIG. 1). The bin normally stands on its base 18 but it has a pair of wheels 20, one at each of the two rear corners of the base, which can be brought into engagement with the ground by tipping the container rearwardly.

A compacting mechanism is fitted to the lid 14 and comprises a compacting plate 22 mounted under the lid and an actuating rod 24 coupled to the compacting plate through an aperture 26 (FIG. 10) in the lid. The rod 24 is slidably located in a channel 28 (FIG. 3) in the lid 14 and has a handgrip 30 at its front end, the aperture 26 being located about midway along the base of the channel 28. The rod 24 has a groove (or slot) 32 along each of its two opposite edges of which only the left hand groove 32 is seen in the drawings. The plate 22 has a bracket 34 moulded or otherwise attached to the plate. The bracket 34 has a pair of upstanding arms 35 with opposite inwardly directed projections 36 at their upper ends, each projection 36 slidably engaging a respective groove 32 in the rod 24 to couple the plate 22 to the rod (only the left hand part of the bracket 34 and the left hand arm 35 and projection 36 are seen in FIGS. 1 to 6).

Figure 2:
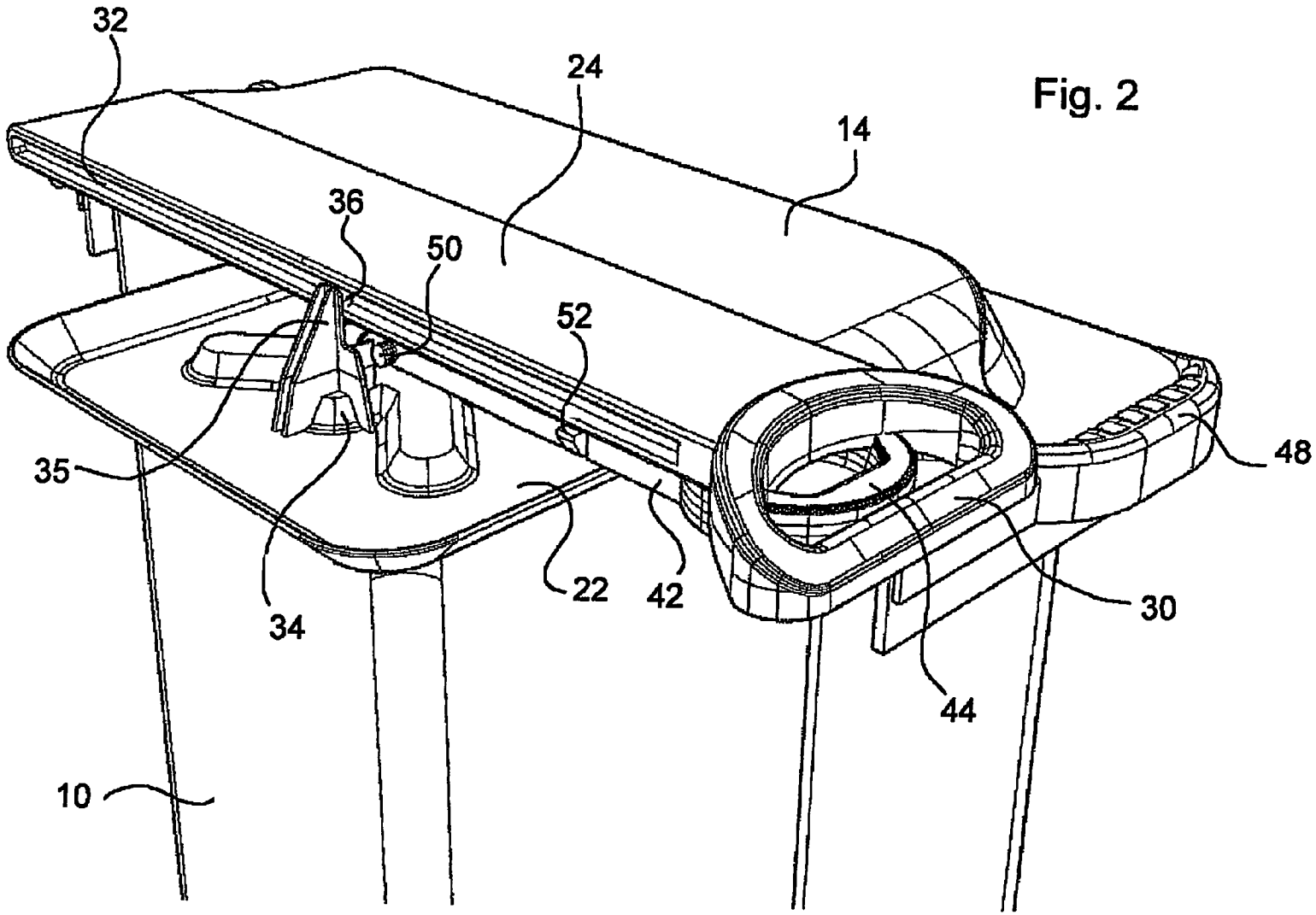
FIG. 2 is an enlarged perspective view of the top of the bin of FIG. 1 with the compacting mechanism drawn up into its storage position, the left hand side (as seen in the figure) of the lid and container being removed to show the component parts.

In the storage position of the compacting mechanism, FIGS. 1 and 2, the actuating rod 24 lies across the top surface of the lid 14 wholly within the channel 28 (except for its handgrip 30) and the compacting plate 22 is drawn up under the lid with the bracket arms 35 passing upwardly through the aperture 26 with the projections 36 engaging the respective grooves 32 intermediate the ends of the rod 24.

Figure 3:
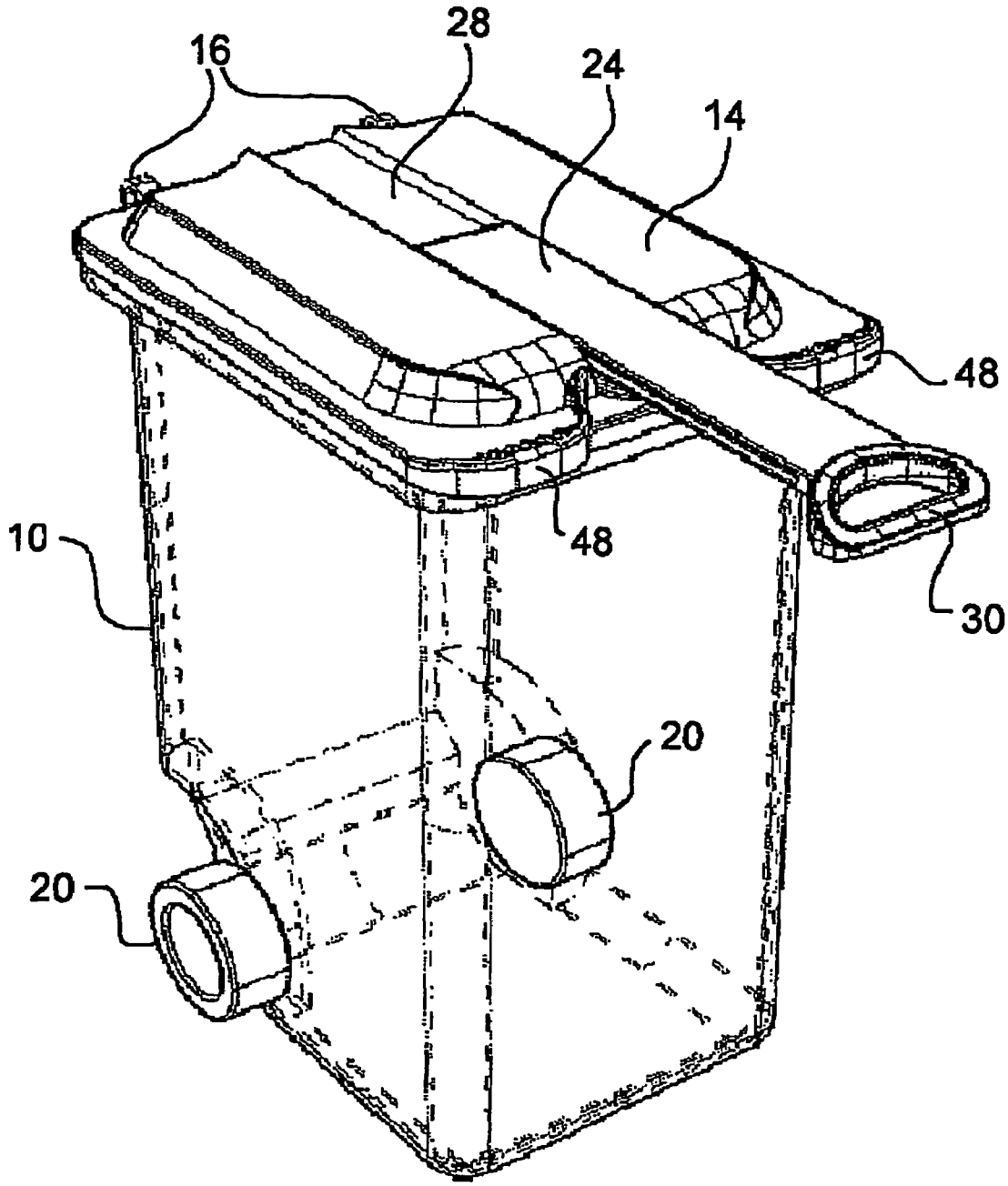
FIG. 3 is a perspective view of the bin of FIG. 1 with the actuating rod slid partially out of its receiving channel in the lid in preparation for use.
Figure 4:
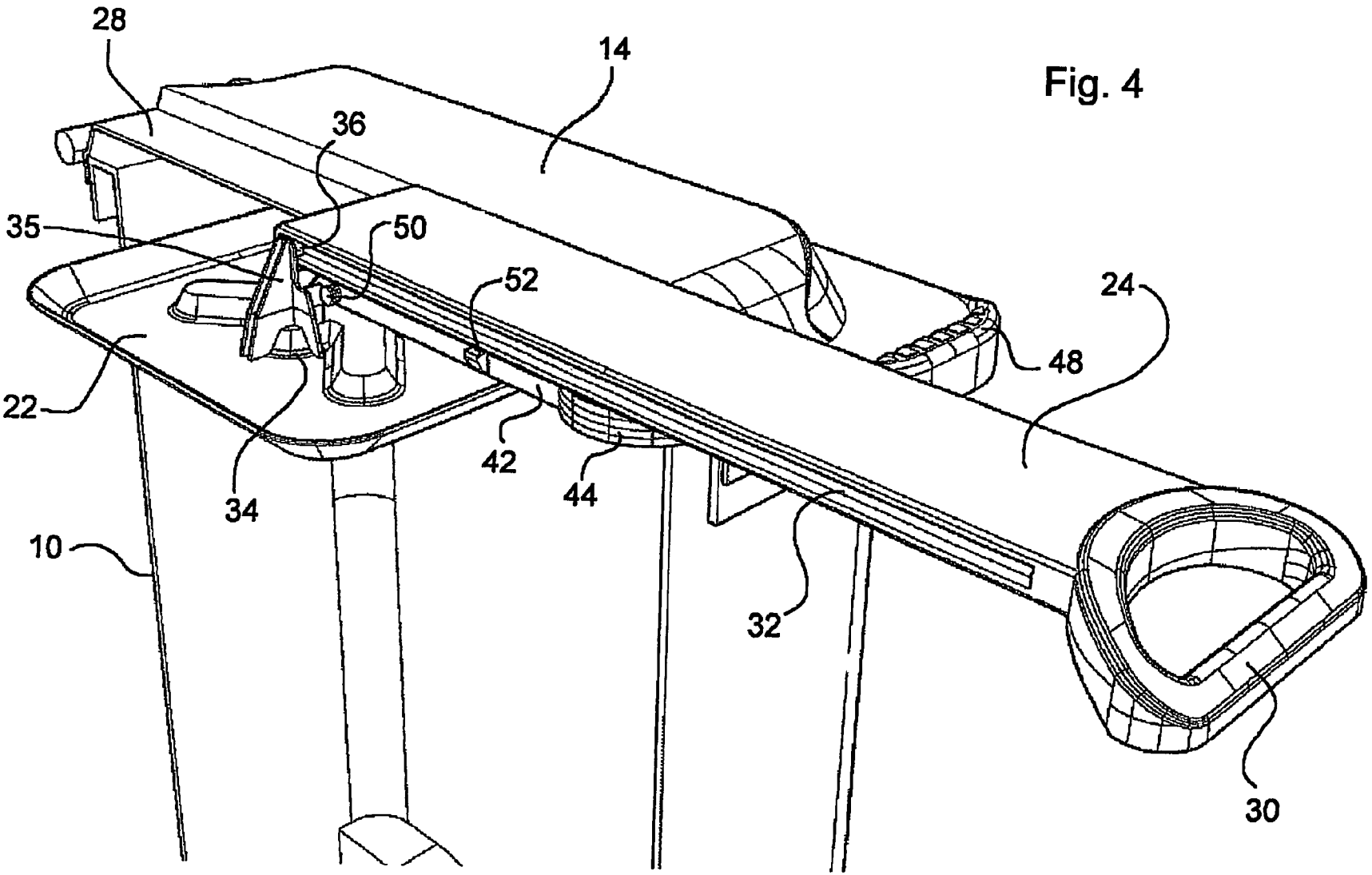
FIG. 4 is a perspective view, similar to FIG. 2, of the top of the bin showing the component parts in the position of FIG. 3.
Figure 5:
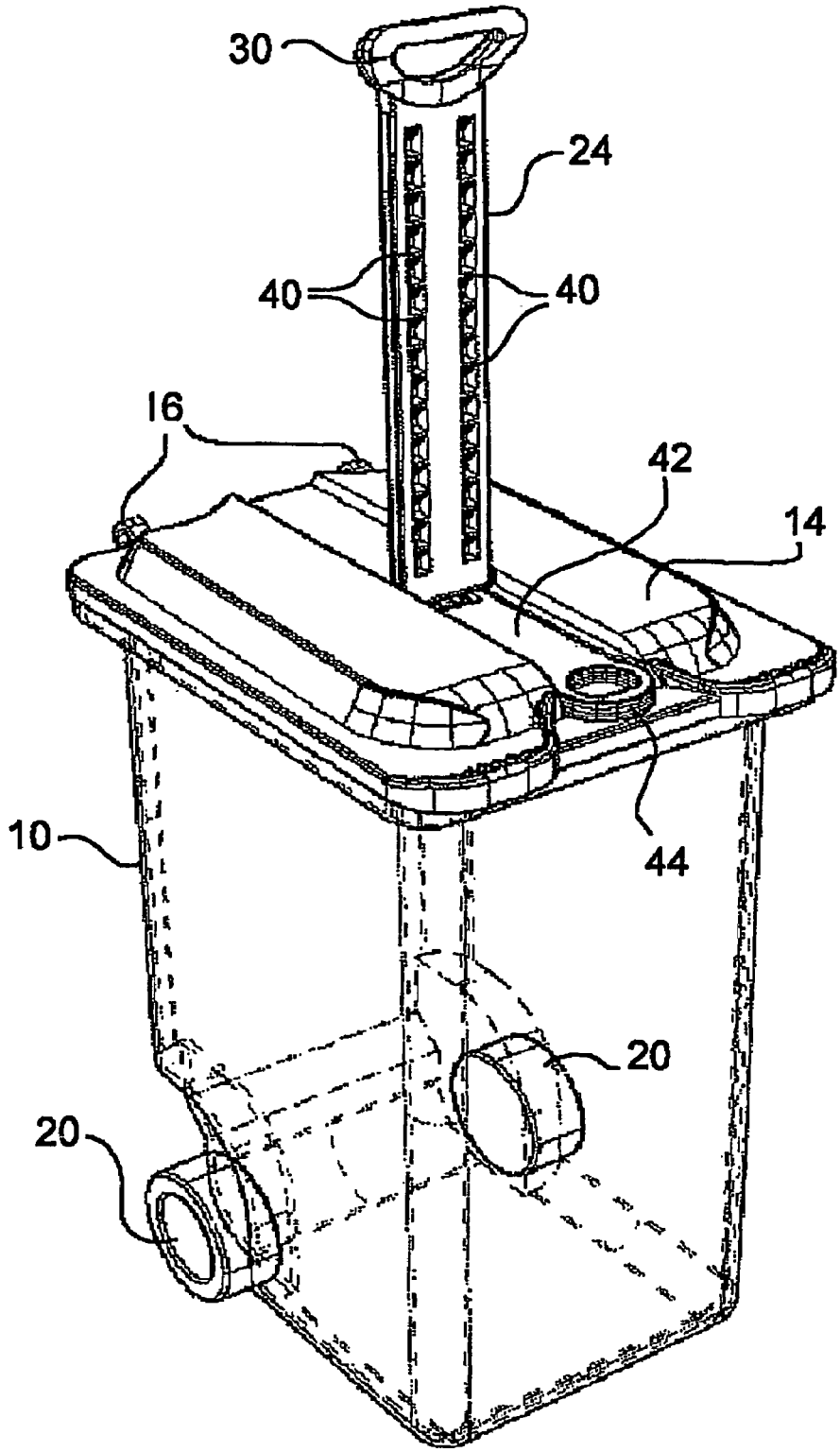
FIG. 5 is a perspective view of the bin with the actuating rod standing vertically over an aperture in the lid ready for use.
Figure 6:
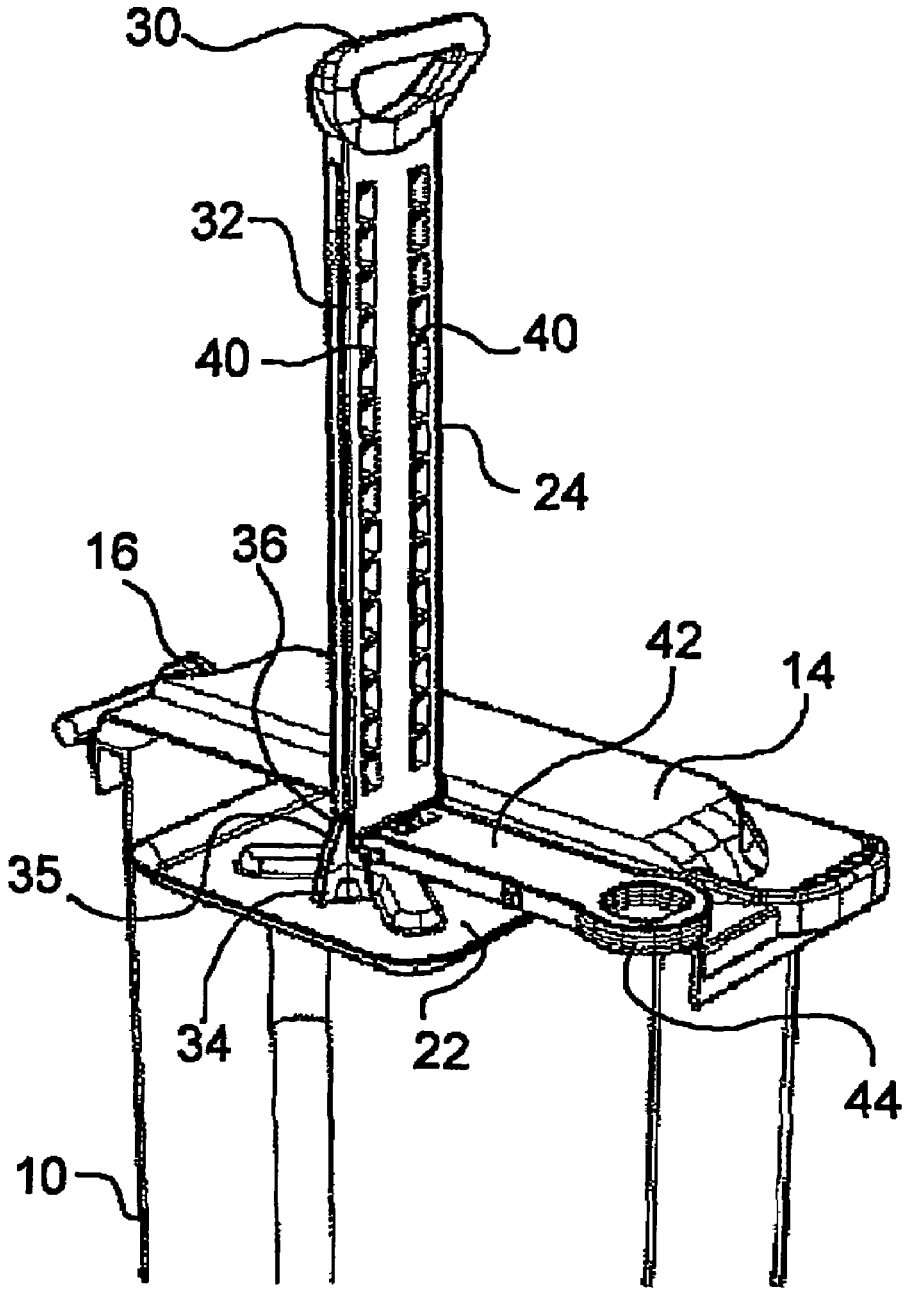
FIG. 6 is a perspective view, similar to FIG. 2, of the top of the bin showing the component parts in the position of FIG. 5.
Figure 7:
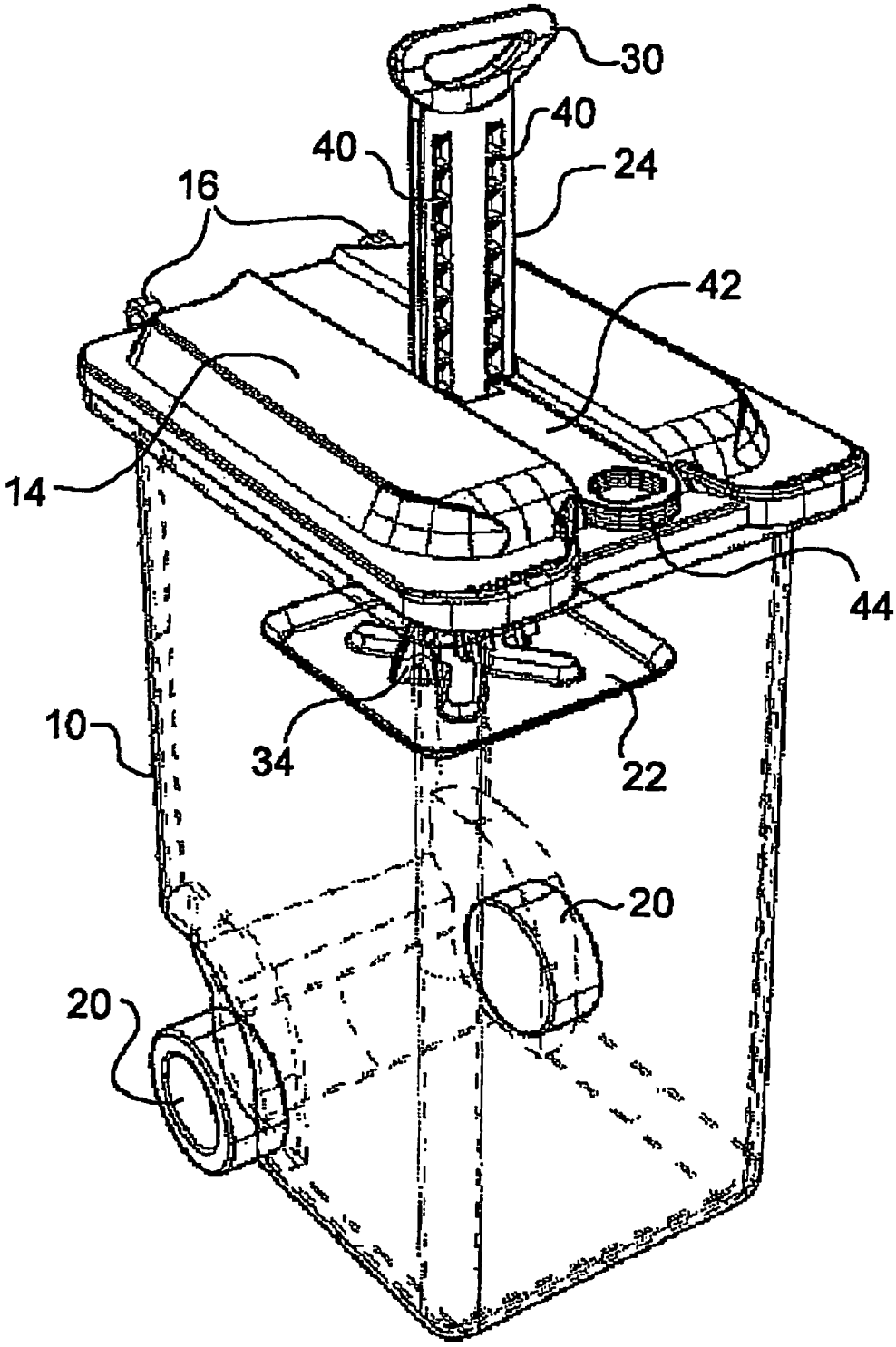
FIG. 7 is a perspective view of the bin with the actuating rod pushed partially down through the aperture in the lid so as to compact refuse in the container.

To deploy the compacting mechanism to its operative position, the handgrip 30 is used to first draw the actuating rod 24 forwardly in the channel 28 along its own axis until the projections 36, which slide in the grooves 32, reach the rear end of the rod, FIGS. 3 and 4. Now the rod 24 is rotated about the projections 36 to stand vertically above the aperture 26, FIGS. 5 and 6. Finally, the rod 24 may now be pushed down through the aperture 26 to drive the compacting plate 22 down into the container 10 to compact refuse therein, FIGS. 7 and 8. FIG. 7 shows the actuating rod pushed partially down through the aperture 26 in the lid and FIG. 8 shows the actuating rod pushed fully down through the aperture 26.

Figure 8:
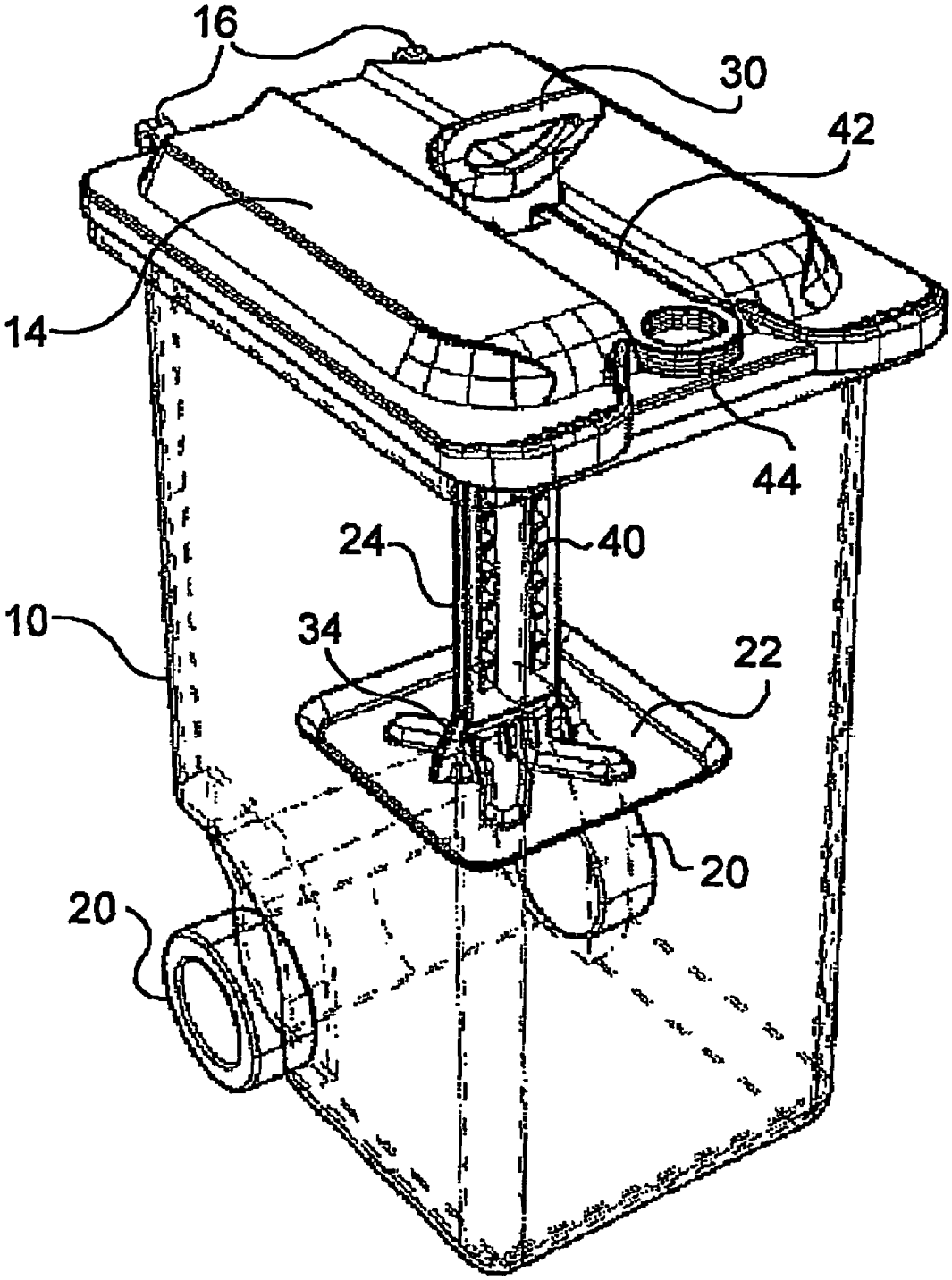
FIG. 8 is a perspective view of the bin with the actuating rod pushed fully down through the aperture in the lid.

The length of the arms 35 is such that, when the rod 24 is vertical as seen in FIGS. 7 and 8 and assuming that no upward force is applied to the plate 22, the lower end of the actuating rod 24 is clear of the bracket 34. In this situation the compacting plate 22 hangs freely from the lower end of the actuating rod 24 and is capable of rotation about the axis of the projections 36 which rest on the closed ends of the grooves 32. However, if the rod 24 is pushed downwardly to compact refuse in the container 10, the upward force on the plate 22 will force the lower end of the rod 24 into the bracket 34 which is so designed as to lock the plate 22 against rotation relative to the rod 24. However, after the refuse has been compacted, lifting the rod 24 removes the upward force on the plate 22 and allows the lower end of the rod to disengage from the bracket 34 so that the plate can once again rotate relative to the rod 24.

The compacting mechanism also includes a ratchet mechanism for releasably locking the actuating rod 24 against movement upwardly through the aperture 26 in the base of the channel 28. The ratchet mechanism comprises two sets of teeth 40 disposed longitudinally along the underside of the actuating rod 24 and a cooperating member ("trigger") 42 resiliently biased into engagement with the teeth.

Figure 11:
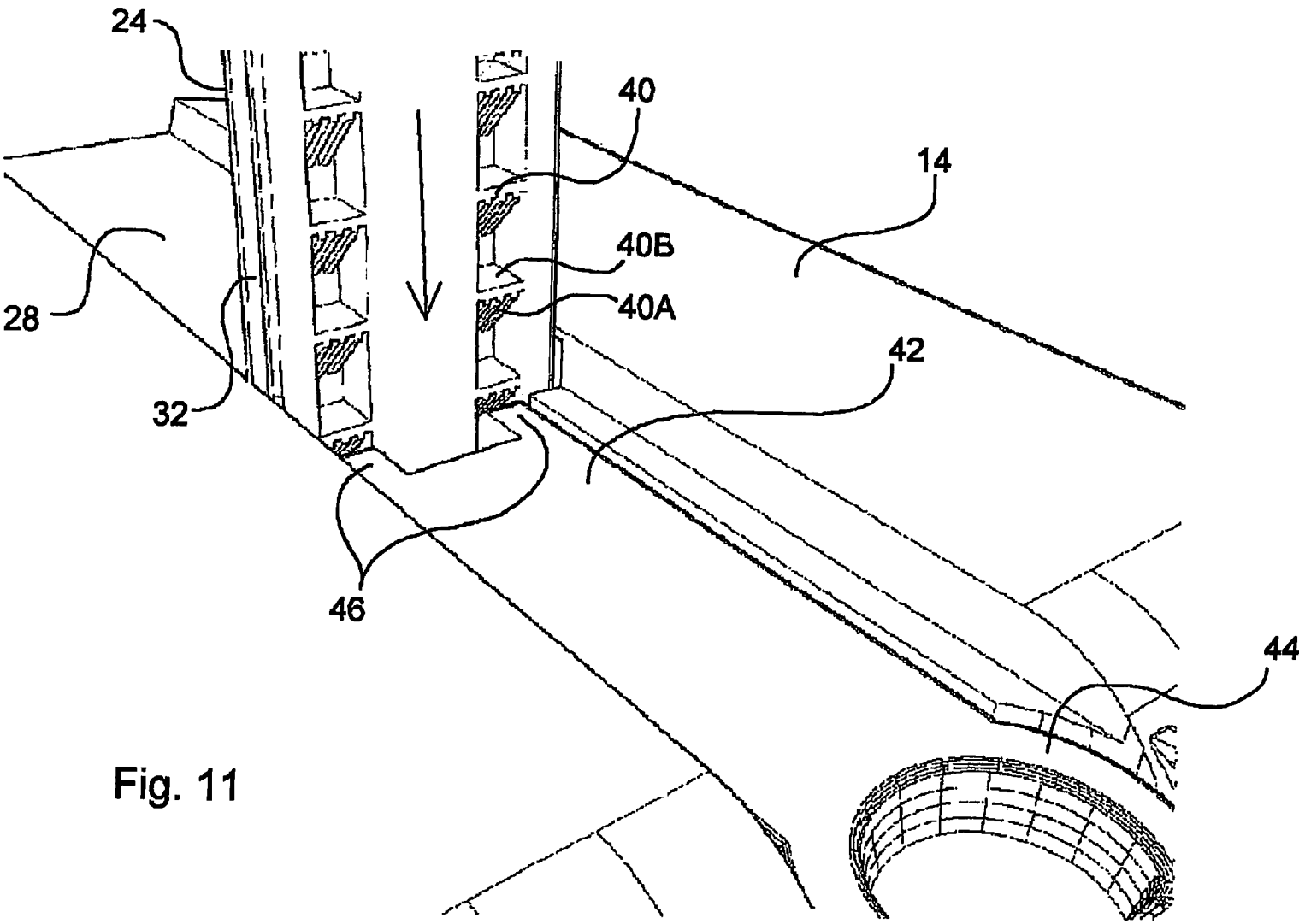
FIG. 11 is an enlarged view of a releasable ratchet mechanism used in the compacting mechanism to allow downward movement only of the actuating rod relative to the lid.
Figure 12:
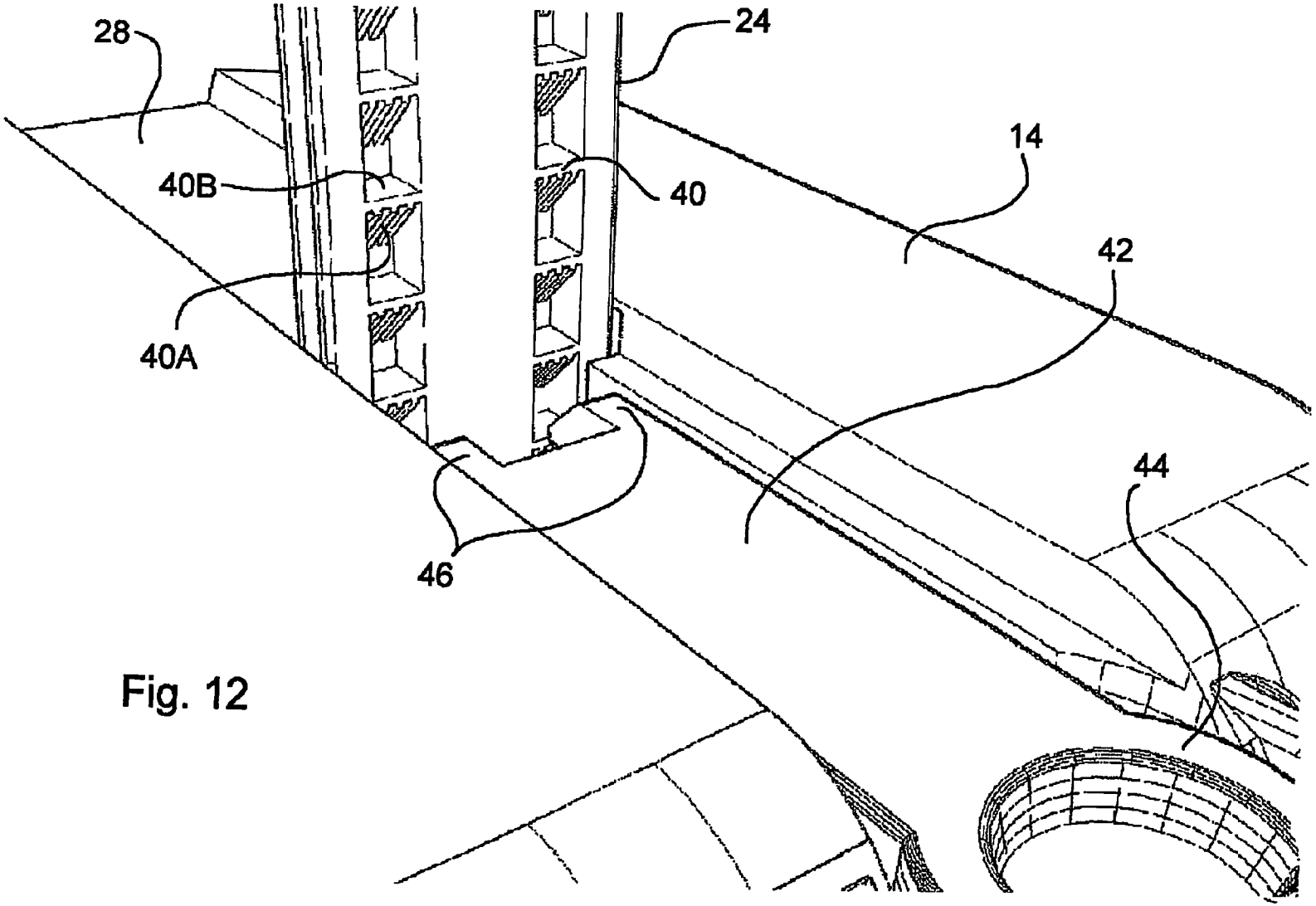
FIG. 12 shows the ratchet mechanism trigger manually withdrawn to release the actuating rod for upward movement relative to the lid.

Referring in particular to FIGS. 11 and 12, the trigger 42 is slidably located in the channel 28 below the rod 24 (when the latter is in its storage position), and has a handgrip 44 at its outer end and a pair of projections 46 at its inner end. The trigger 42 is resiliently biased, by a spring to be described, towards the rod 24 such that the projections 46 engage the teeth 40 when the rod 24 passes through the aperture 26. Each tooth 40 has an inclined lower surface 40A and an upper surface 40B which is normal to the longitudinal direction of the rod 24. The projections 46 are profiled such that when the rod 24 is pushed downwardly relative to the lid 14 the trigger 42 is cammed outwardly, against its spring bias, by each inclined surface 40A so that the rod 24 is allowed to move downwards through the aperture 26. However, the projections 46 lock up against the surfaces 40B when the rod 24 is attempted to be moved upwardly through the aperture 26, thereby preventing such upward movement. This allows the lid 14 to be used in the following manner as a lever to assist compaction.

Figure 9:
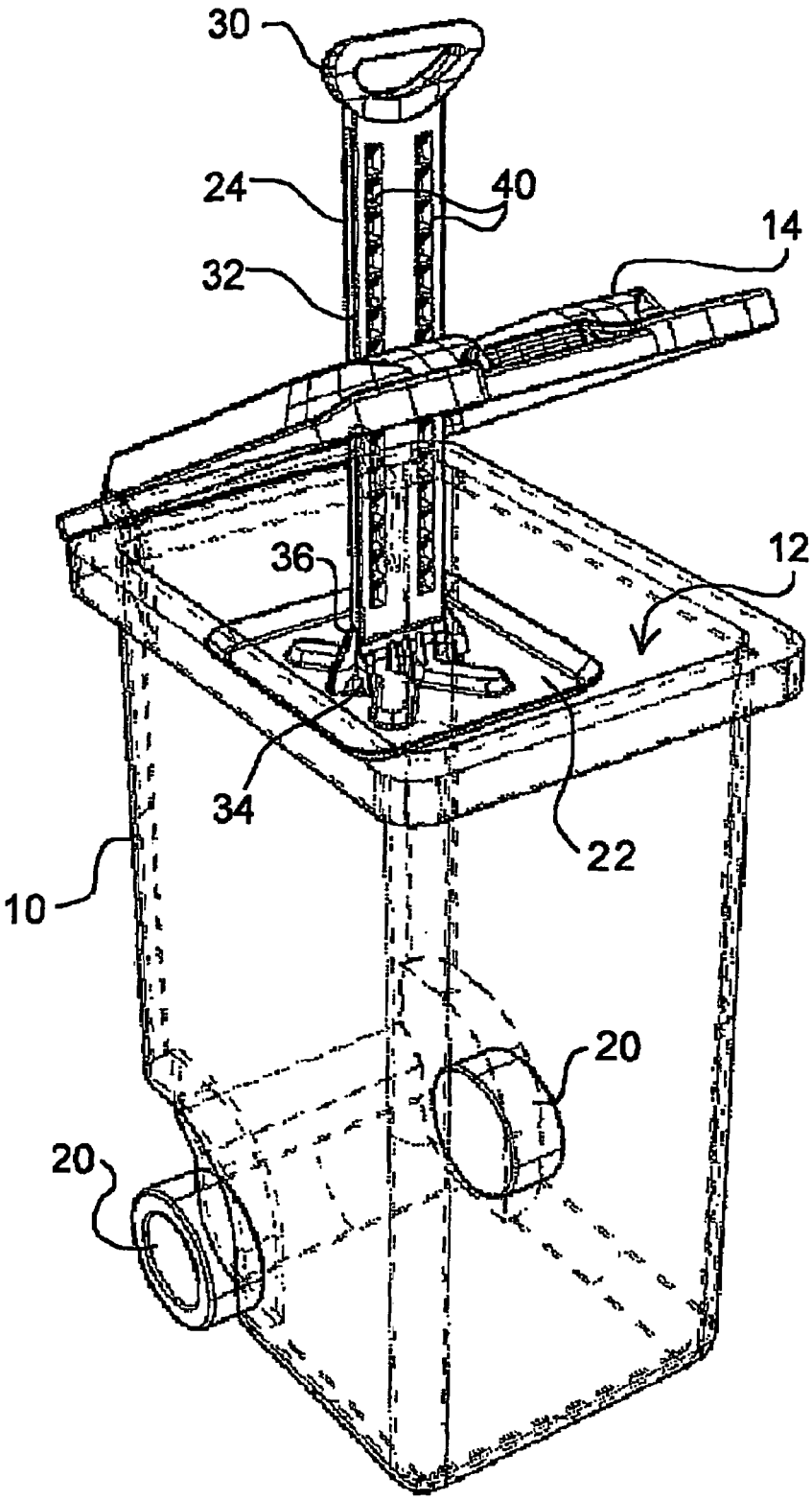
FIG. 9 is a perspective view of the bin illustrating the use of the lid as a lever to increase the compaction force.
Figure 10:
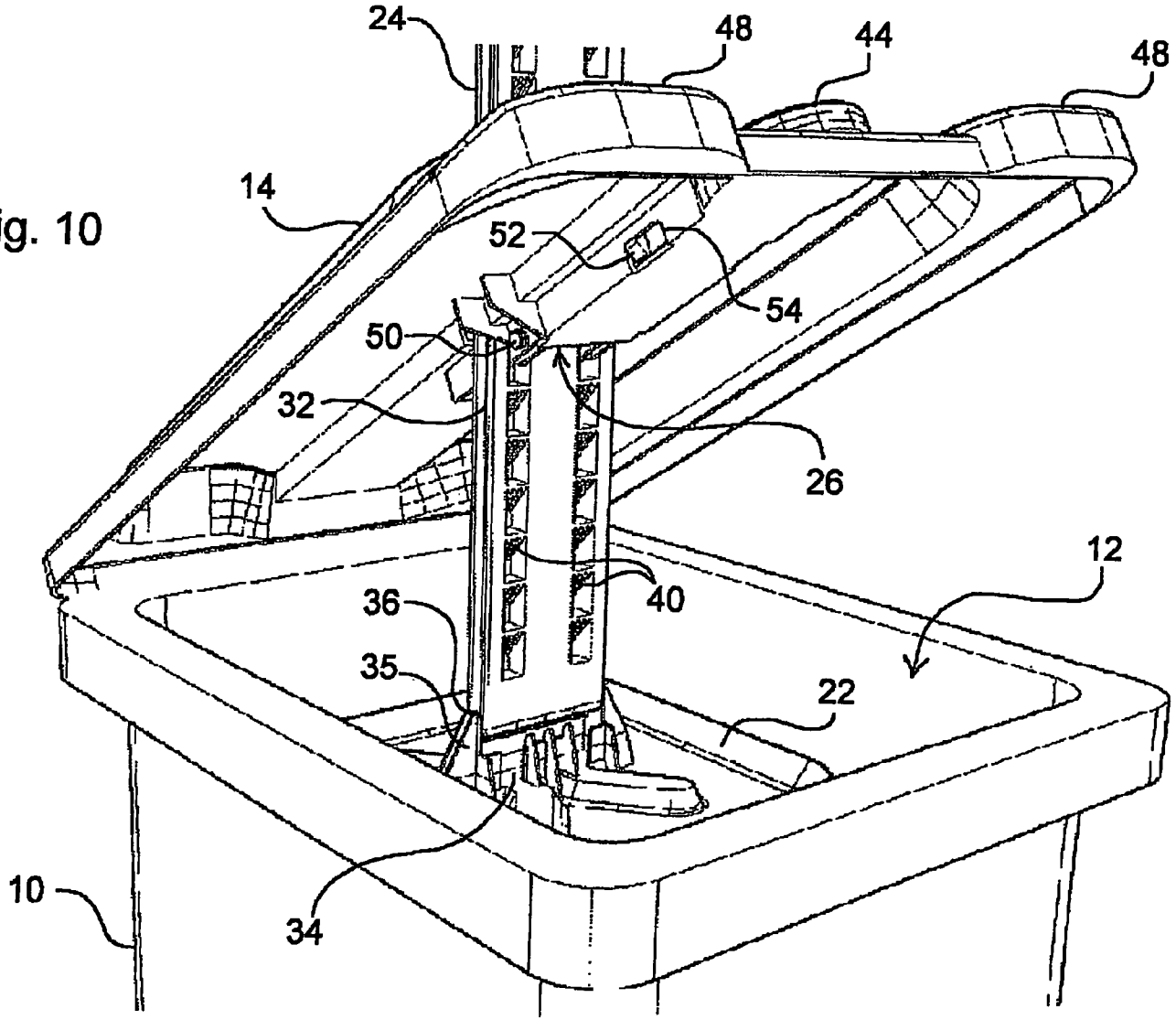
FIG. 10 is an enlarged perspective view of the inside of the lid when used as a lever as shown in FIG. 9.

The lid is raised, FIGS. 9 and 10, and the arm 24 is pushed down through the aperture 26 until it meets the top of the refuse to be compacted. Now, the front edge of the lid 14, i.e. the edge opposite the hinges 16, is gripped using handgrips 48 moulded into the front edge of the lid and pushed downwardly. Since the rod 24 cannot move upwardly relative to the lid, due to the trigger 42 locking against the surfaces 40B, the rod 24 and plate 22 are forced down to compact the refuse. However, the rod 24 can be released for upward movement relative to the lid 14, e.g. when it is desired to move the rod to its storage position, by pulling on the handgrip 44 to disengage the projections 46 from the teeth 40 against the spring bias on the trigger 42, FIG. 12.

Figure 13:
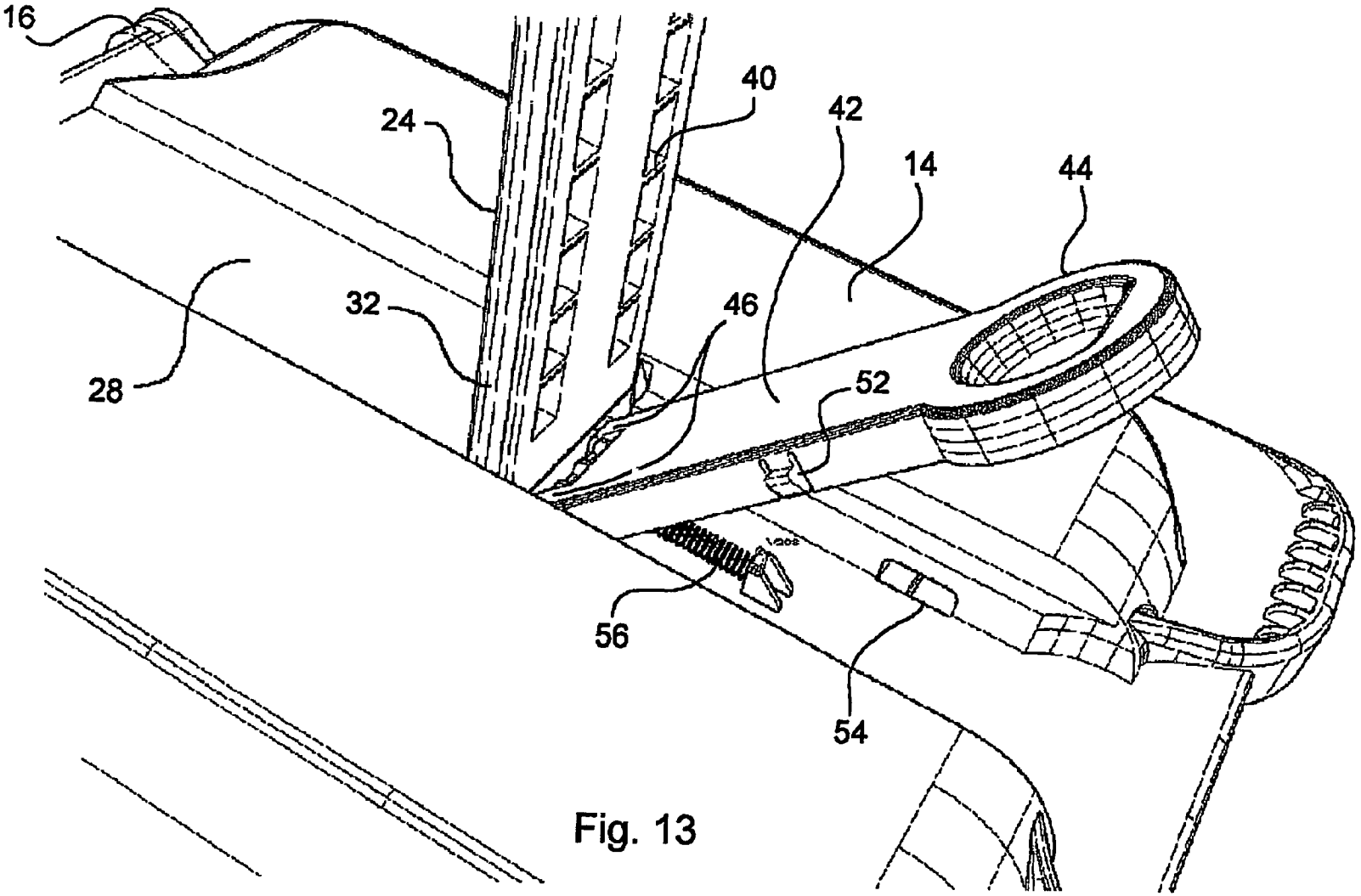
FIG. 13 shows the construction of the ratchet mechanism trigger.

FIG. 13 shows the construction of the trigger 42. In FIG. 13 the trigger has been rotated out of its normal operating position to show the features of its construction. In normal use, as shown in the other figures, it lies below the rod 24 flush with the base of the channel 28. On each side edge the trigger 42 has a stud 50 (FIGS. 2, 4 and 10) and a wedge 52. Each stud 50 slides in a slot (not shown) in the respective sidewall of the channel 28, and each wedge 52 slides in a respective slot 54 (FIGS. 10 and 13) in a respective sidewall of the channel. The trigger 42 is snap-fitted into place, the studs 50 first being inserted in their slots (FIG. 13) and the trigger then being rotated down about the studs 50 so that the wedges 52 snap fit in their respective slots 54. The trigger 42 can now move only by sliding towards and away from the rod 24 as shown in FIGS. 11 and 12. A compression spring 56 acting between the lid and trigger biases the trigger 42 towards the teeth 40.

Although the foregoing has described the compacting mechanism fitted to a lid 14 directly hinged to the container 10, the lid could equally well be hinged to a wall or other vertical surface above a separate container.

The invention is not limited to the embodiment described herein which may be modified or varied without departing from the scope of the invention.

The invention claimed is:

1. A refuse bin comprising a refuse container having a top opening, a lid hinged relative to the container by a hinge to cover the opening, and a compacting mechanism fitted to the lid, the compacting mechanism comprising a compacting plate mounted under the lid and an actuating rod coupled to the compacting plate through an aperture in the lid such that the rod is configured to maneuver from a storage position in which the rod lies across a top surface of the lid and the plate is drawn up under the lid to an operative position in which the rod stands upright over the aperture in the lid and the rod is pushed downwardly through the aperture to push the plate down into the container, the compacting mechanism further comprising means for releasably locking the actuating rod against movement upwardly through the aperture in the lid such that refuse in the container can be compacted by force applied to an edge of the lid opposite the hinge, the means for releasably locking the actuating rod comprises a ratchet mechanism, wherein the ratchet mechanism comprises a set of teeth disposed along a surface of the actuating rod and a cooperating member mounted on the top surface of the lid is resiliently biased into engagement with the teeth.

2. A refuse bin as claimed in claim 1, wherein the cooperating member may be manually moved against the resilient bias to disengage the member from the teeth and allow upward movement of the rod through the aperture.

3. A refuse bin as claimed in claim 1, wherein the compacting plate is slidably and pivotally coupled to the actuating rod such that in the storage position of the rod the plate is coupled to the rod by a coupling means at a point intermediate its ends, the rod being maneuverable to the operative position by sliding the rod along its own axis until the coupling means reaches one end of the rod and then rotating the rod upwardly about said one end.

4. A refuse bin as claimed in claim 3, wherein the lid comprises a channel and the actuating rod being located in and slidable along the channel.

5. A refuse bin as claimed in claim 3, wherein the other end of the actuating rod has a handgrip.

6. A refuse bin as claimed in claim 1 wherein the container has a pair of wheels at a base which can be brought into engagement with a ground by tipping the container.

7. A refuse bin as claimed in claim 1, wherein the lid is hinged to the container at one edge of the opening.

8. A hinged lid for a refuse container having a top opening, the lid including a compacting mechanism comprising a compacting plate mounted under the lid and an actuating rod coupled to the compacting plate through an aperture in the lid such that the rod is configured to maneuver from a storage position in which the rod lies across a top surface of the lid and the plate is drawn up under the lid to an operative position in which the rod stands upright over the aperture in the lid and the rod is pushed downwardly through the aperture to push the plate down into a container below, the compacting mechanism further comprising means for releasably locking the actuating rod against movement upwardly through the aperture in the lid such that refuse in the container can be compacted by force applied to an edge of the lid opposite a hinge, the means for releasably locking the actuating rod comprises a ratchet mechanism, wherein the ratchet mechanism comprises a set of teeth disposed along a surface of the actuating rod and a cooperating member mounted on the top surface of the lid is resiliently biased into engagement with the teeth.

9. A refuse bin as claimed in claim 2, wherein the compacting plate is slidably and pivotally coupled to the actuating rod such that in the storage position of the rod the plate is coupled to the rod by a coupling means at a point intermediate its ends, the rod being maneuverable to the operative position by sliding the rod along its own axis until the coupling means reaches one end of the rod and then rotating the rod upwardly about said one end.

10. A refuse bin as claimed in claim 9, wherein the lid comprises a channel and the actuating rod being located in and slidable along the channel.

11. A refuse bin as claimed in claim 4, wherein the other end of the actuating rod is a handgrip.

12. A refuse bin as claimed in claim 9, wherein the other end of the actuating rod has a handgrip.

13. A refuse bin as claimed in claim 10, wherein the other end of the actuating rod has a handgrip.

* * * * *